US011426650B2

(12) United States Patent
Dowell

(10) Patent No.: US 11,426,650 B2
(45) Date of Patent: Aug. 30, 2022

(54) CHESS GAME AND METHOD OF PLAY

(71) Applicant: Joseph Dowell, Christiana, TN (US)

(72) Inventor: Joseph Dowell, Christiana, TN (US)

( * ) Notice: Subject to any disclaimer, the term of this patent is extended or adjusted under 35 U.S.C. 154(b) by 0 days.

(21) Appl. No.: 14/807,836

(22) Filed: Jul. 23, 2015

(65) Prior Publication Data

US 2017/0014709 A1 Jan. 19, 2017

Related U.S. Application Data

(60) Provisional application No. 62/193,112, filed on Jul. 16, 2015.

(51) Int. Cl.
*A63F 3/02* (2006.01)
*A63F 3/00* (2006.01)

(52) U.S. Cl.
CPC ..... *A63F 3/02* (2013.01); *A63F 3/00176* (2013.01); *A63F 2003/00195* (2013.01); *A63F 2003/00785* (2013.01)

(58) Field of Classification Search
CPC ..... A63F 3/02; A63F 3/00176; A63F 2003/00195; A63F 2003/00785
See application file for complete search history.

(56) References Cited

U.S. PATENT DOCUMENTS 3,963,242 A * 6/1976 Treugut ..... A63F 3/00176 273/261
3,964,747 A * 6/1976 Balmforth ..... A63F 3/00176 273/261
4,580,787 A * 4/1986 Baker ..... A63F 3/00176 273/261
4,696,478 A 9/1987 Farrell
5,536,014 A 7/1996 Serfozo
5,582,410 A * 12/1996 Hunt ..... A63F 3/00176 D21/348
5,690,334 A 11/1997 Duke
5,749,583 A * 5/1998 Sadounichvili ..... A63F 3/02 273/260
6,070,871 A * 6/2000 Wilson ..... A63F 3/00176 273/261
6,098,982 A * 8/2000 Campusano ..... A63F 3/00176 273/261
6,116,602 A 9/2000 Mcloy
6,170,826 B1 * 1/2001 Jones ..... A63F 3/00176 D21/348

(Continued)

OTHER PUBLICATIONS

International Preliminary Examination and Search Report, PCT/US15/41853 (filed Jul. 23, 2015).

*Primary Examiner* — Michael D Dennis
(74) *Attorney, Agent, or Firm* — Wayne Edward Ramage; Baker Donelson

(57) ABSTRACT

A fantasy-based variant of chess that can be played by two to six players on one of several distinct game boards. Game boards are two-dimensional, and comprise a plurality of square or hexagonal play spaces arranged into a variety of polygonal shapes. Square play spaces alternate in color (e.g., light, dark), while hexagonal play spaces may be arranged in concentric rings or "circuits" of alternating color (e.g., light, dark). New types of pieces are introduced, including Dragons, Giants, Beasts, Wizards, and Mercenaries. The number and arrangement of game pieces per player varies depending on the game board.

4 Claims, 5 Drawing Sheets

(56) References Cited

U.S. PATENT DOCUMENTS

| | | | | |
|---|---|---|---|---|
| 6,416,056 | B1 * | 7/2002 | Knieriemen | A63F 3/00176 273/261 |
| 6,592,123 | B1 | 7/2003 | Mattlage et al. | |
| 6,902,165 | B1 | 6/2005 | Hunt et al. | |
| D550,776 | S * | 9/2007 | Myers | D21/349 |
| 7,434,806 | B2 * | 10/2008 | Budden | A63F 3/02 273/255 |
| 7,722,044 | B2 * | 5/2010 | Polgar | A63F 3/02 273/255 |
| 8,448,946 | B2 | 5/2013 | Svatovic | |
| 8,678,390 | B2 | 3/2014 | Guyer | |
| 2005/0212209 | A1 * | 9/2005 | Reynolds | A63F 3/02 273/260 |
| 2006/0279042 | A1 * | 12/2006 | Stevenson | A63F 3/02 273/260 |
| 2007/0063436 | A1 * | 3/2007 | Polgar | A63F 3/00176 273/260 |
| 2010/0072703 | A1 * | 3/2010 | Samaniego | A63F 3/02 273/261 |
| 2010/0078889 | A1 * | 4/2010 | Owen | A63F 3/00176 273/261 |
| 2011/0127719 | A1 * | 6/2011 | Hornik | A63F 3/00643 273/238 |
| 2012/0025463 | A1 * | 2/2012 | Guyer | A63F 3/02 273/261 |
| 2016/0263471 | A1 * | 9/2016 | O'Connor | A63F 3/02 |

* cited by examiner

CHESS GAME AND METHOD OF PLAY

This application claims benefit of and priority to U.S. Provisional Application No. 61/028,100, filed Jul. 23, 2014, and No. 62/193,112, filed Jul. 16, 2015, by Joseph Dowell, and is entitled to those filing dates for priority. The specifications, figures, appendices, and complete disclosure of U.S. Provisional Application Nos. 61/028,100 and 62/193,112 are incorporated herein in their entireties by specific reference for all purposes.

FIELD OF INVENTION

This invention relates to an apparatus and method for playing games, and more specifically to an apparatus and method for playing a variant of the game of chess.

BACKGROUND OF THE INVENTION

The game of chess has been known for hundreds of years, and continues to be a popular game due to its strategic complexity. An extensive history and analysis of the game of chess is disclosed in Duke, U.S. Pat. No. 5,690,334, which is incorporated herein in its entirety by specific reference for all purposes. However, the traditional or orthodox game of chess has a limited number of pieces, is played on a relatively small 8×8 square board, and is limited to two players.

A number of variants of the game of chess have been invented. Duke, cited above, modified the game board to a 10×8 square board with a new piece added. Svatovic, U.S. Pat. No. 8,448,946, modified the game board to a 10×10 square board, also with a piece (the esquire) added. Guyer, U.S. Pat. No. 8,678,390, modified the game board to be a 7×7 diamond-shaped board with hexagonal spaces, using a sub-set of the standard chess pieces. And Mattlage, U.S. Pat. No. 6,592,123, modified the game board to be circular, with 72 spaces arranged in concentric circles. U.S. Pat. Nos. 6,592,123; 8,448,946; and 8,678,390 are incorporated herein in their entireties by specific reference for all purposes.

SUMMARY OF INVENTION

In various embodiments, the present invention comprises a game which is a fantasy-based variant of chess. It can be played by two to six players on one of several distinct game boards. Game boards are two-dimensional, and comprise a plurality of square or hexagonal play spaces arranged into a variety of polygonal shapes. As described below, each board is referred to as a "realm."

In a two-player embodiment (the "Wizard Realm"), the board comprises an 8×14 center section, with two 2×10 player home areas or rows extending from the center of opposing sides of the center section, all with square play spaces. Four single special play spaces extend from each corner of the center section. Each of the two players starts with 21 matching pieces: the set of standard 16 chess pieces, plus five additional pieces. Certain areas of the board are specially marked, as described below.

In a four-player embodiment (the "Dragon Realm"), the board comprises a 14×14 center section, with four 2×10 player home rows extending from the center of each side, all with square play spaces. Four single special play spaces extend each from each corner of the center section. Each of the four players starts with 21 matching pieces: the set of standard 16 chess pieces, plus five additional pieces. Certain areas of the board are specially marked, as described below.

In a three-player embodiment (the "Bishop Realm"), the board comprises a center section with a plurality of hexagonal play spaces forming a hexagon with 7 hexagonal play spaces along each edge. Three single special hexagonal play spaces extend each from every other vertex of the center section, while clusters of 23 hexagonal spaces form a player home area centered on the other vertices. Each of the three players starts with 21 matching pieces: the set of standard 16 chess pieces, plus five additional pieces. Certain areas of the board are specially marked, as described below.

In a six-player embodiment (the "Melee Realm"), the board comprises a center section with a plurality of hexagonal play spaces forming a hexagon with 9 hexagonal play spaces along each edge. Six pairs of special hexagonal play spaces extend from near the center of each edge of the hexagonal center section, while a cluster of 8 hexagonal spaces centered on each vertex form a player home area (including the vertex). Each of the players starts with 13 matching pieces, including one each of the five additional pieces. Certain areas of the board are specially marked, as described below.

In a five-player embodiment (the "Siege Realm"), the board comprises a center section with a plurality of hexagonal play spaces forming a hexagon with 11 hexagonal play spaces along each edge. Three single special hexagonal play spaces extend each from every other vertex of the center section, while three pairs of special hexagonal play spaces extend from near the center of three alternating edges of the hexagonal center section. Clusters cluster of 10 hexagonal spaces each centered on three alternating vertices (i.e., the vertices without special hexagonal play spaces) form a player home area (including the vertex). Certain spaces around the center are designated as impassible (e.g., castle walls). Players are designated as attacking or defending. Each of the attacking players starts with 15 matching pieces, including one each of the five additional pieces. The defending players start with a total of 43 pieces, including three each of the five additional pieces. Only one defending king is used. Certain areas of the board are specially marked, as described below.

Each of the above boards shares the following specially-marked spaces:

Dragon Squares or Spaces—marked by red flame; allows Dragon pieces to fly across the board. Isolated Dragon Squares or Spaces that extend from the corners or vertices of a board may be referred to as "Dragon Lairs."

Wizard Squares or Spaces—marked by silhouette of a wizard with stars; controls a "Wizard Zone" comprising a zone of contiguous spaces marked with a star.

For the two, three and four player games, each player controls the 16 pieces of standard chess (King, Queen, Rook, Bishop, Knight, Pawn), plus five additional pieces. Unless otherwise noted herein, the movement of the standard chess pieces is according to the orthodox rules of chess. For the 5 and 6 player games, each player controls a subset of those pieces.

In addition to the standard chess pieces (King, Queen, Rook, Bishop, Knight, Pawn), the new pieces are the Beast, the Giant, the Mercenary, the Wizard, and the Dragon. The starting positions, movement rules, and capture rules for the pieces can vary depending on the board used, and are set forth more fully in the attached appendix to the specification, which is incorporated herein by specific reference.

DETAILED DESCRIPTION OF EXEMPLARY EMBODIMENTS

Figure 1:
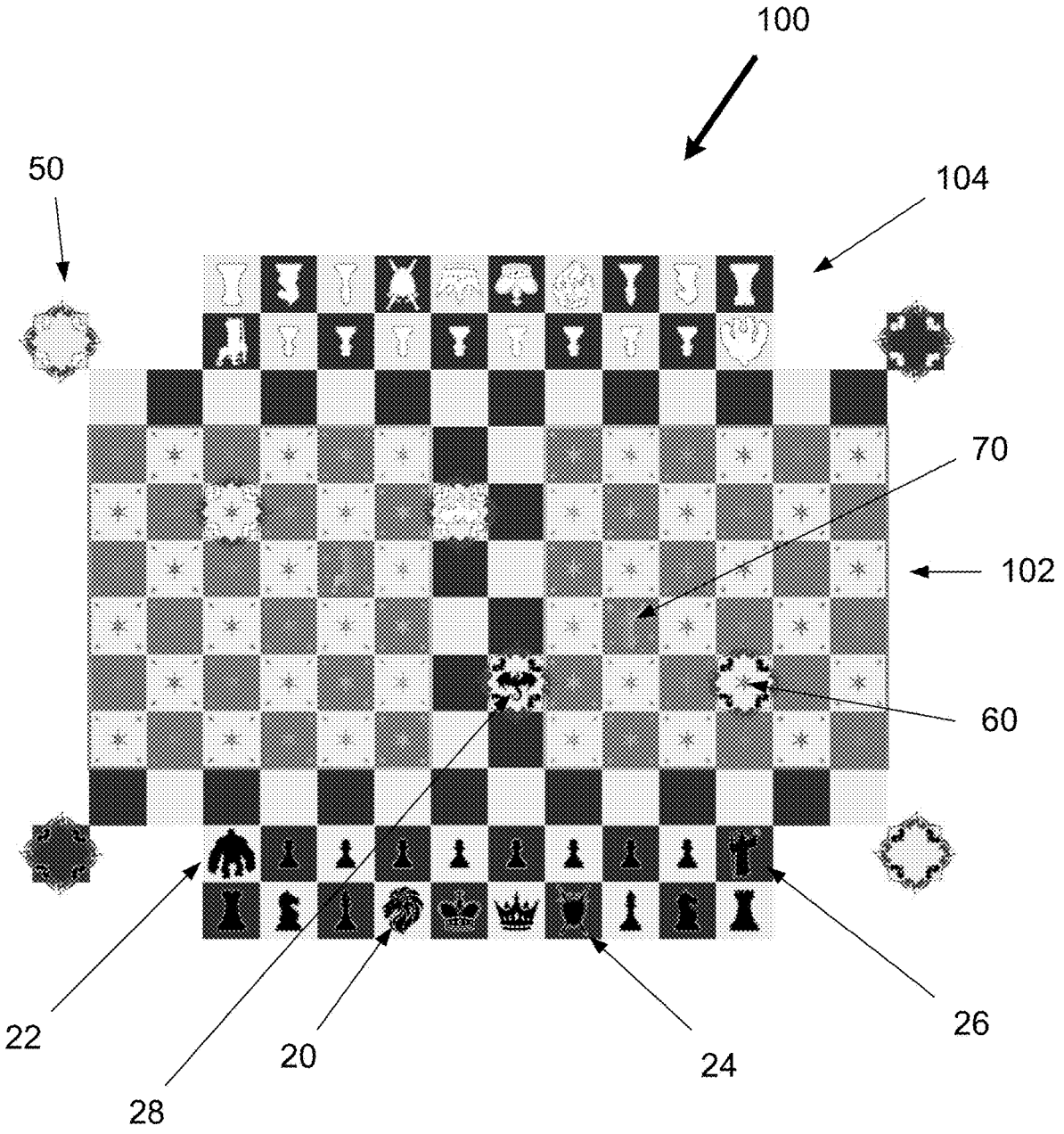
FIG. 1 shows a two-person playing board with pieces in starting positions.
Figure 2:
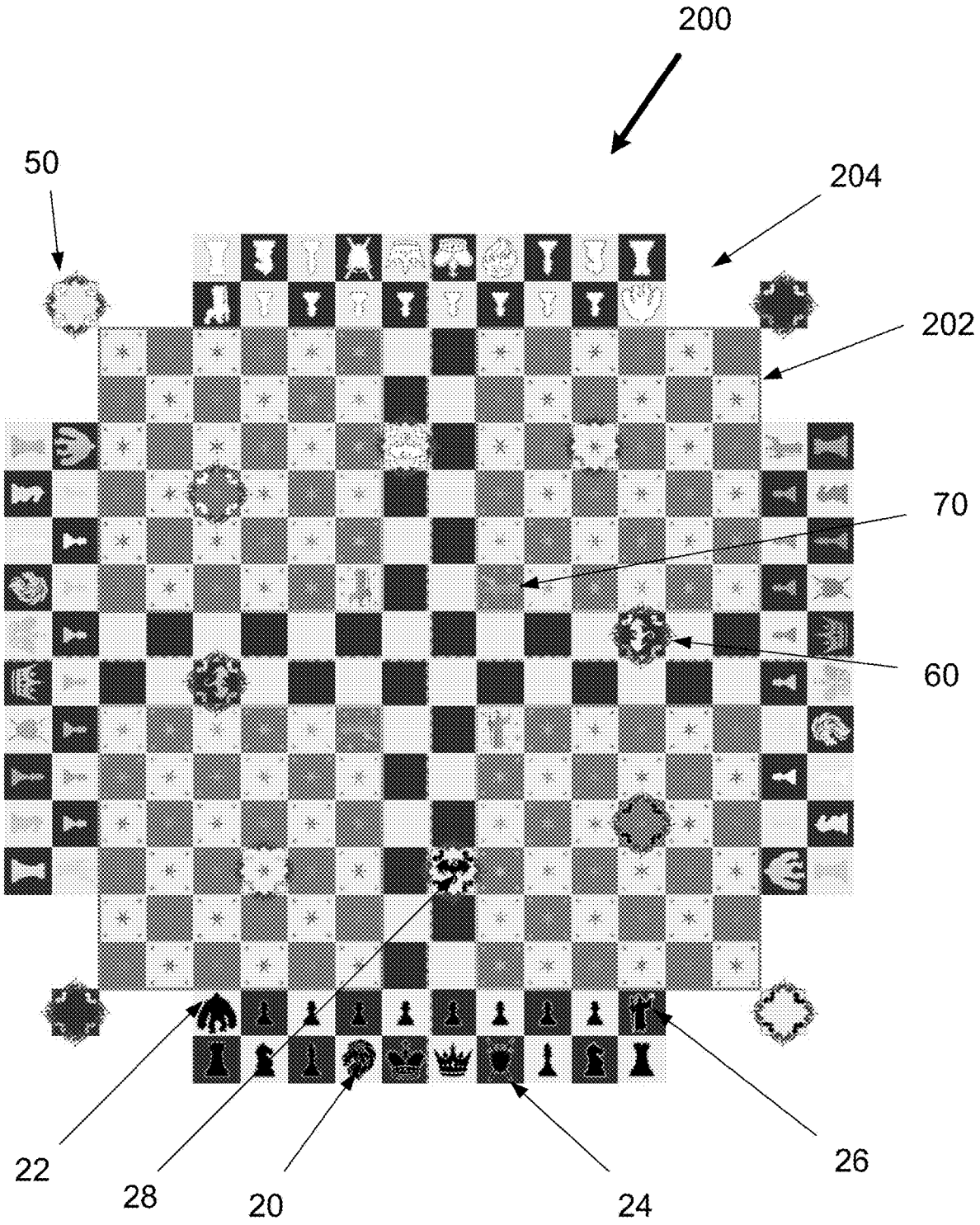
FIG. 2 shows a four-person playing board with pieces in starting positions.
Figure 3:
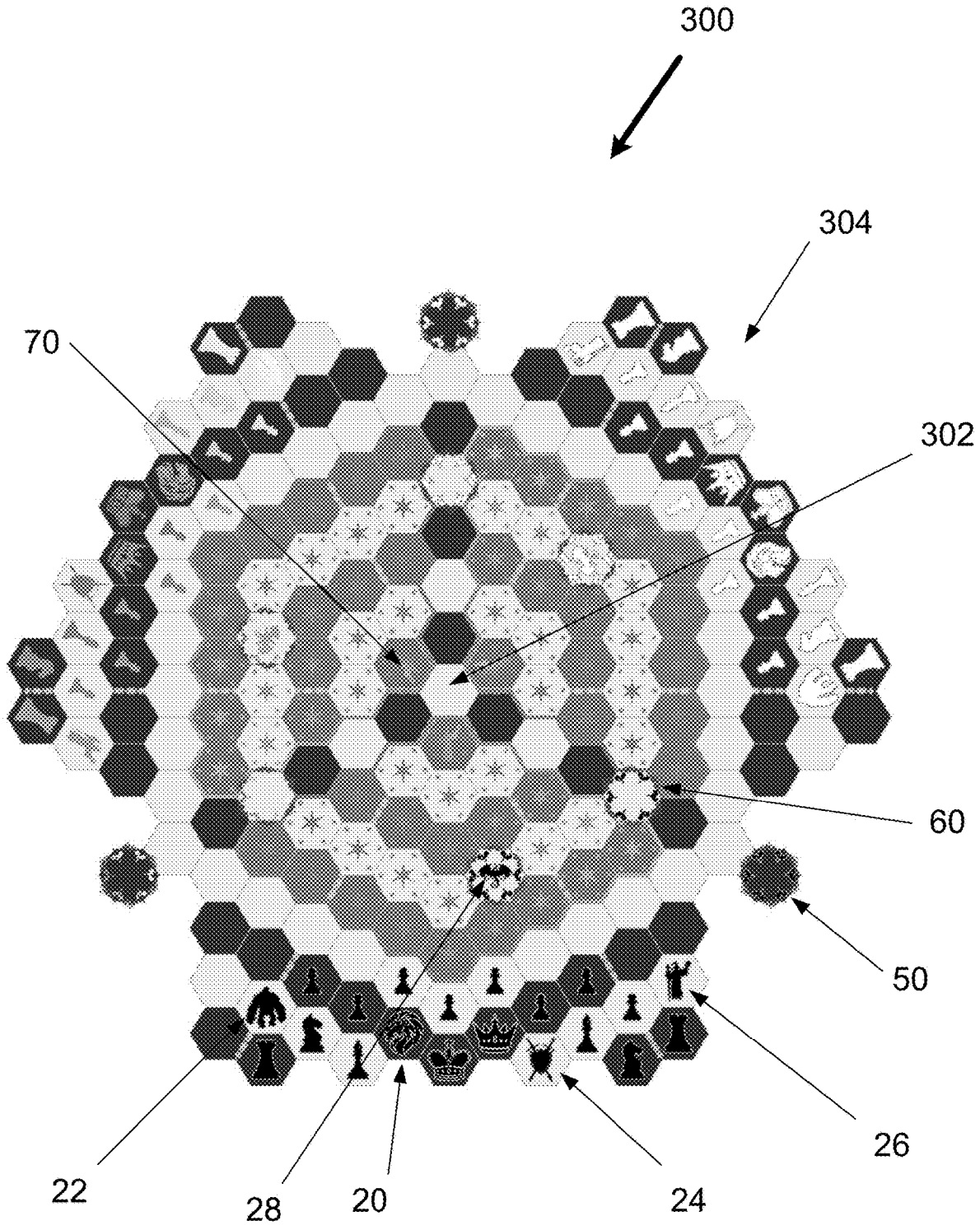
FIG. 3 shows a three-person playing board with pieces in starting positions.
Figure 4:
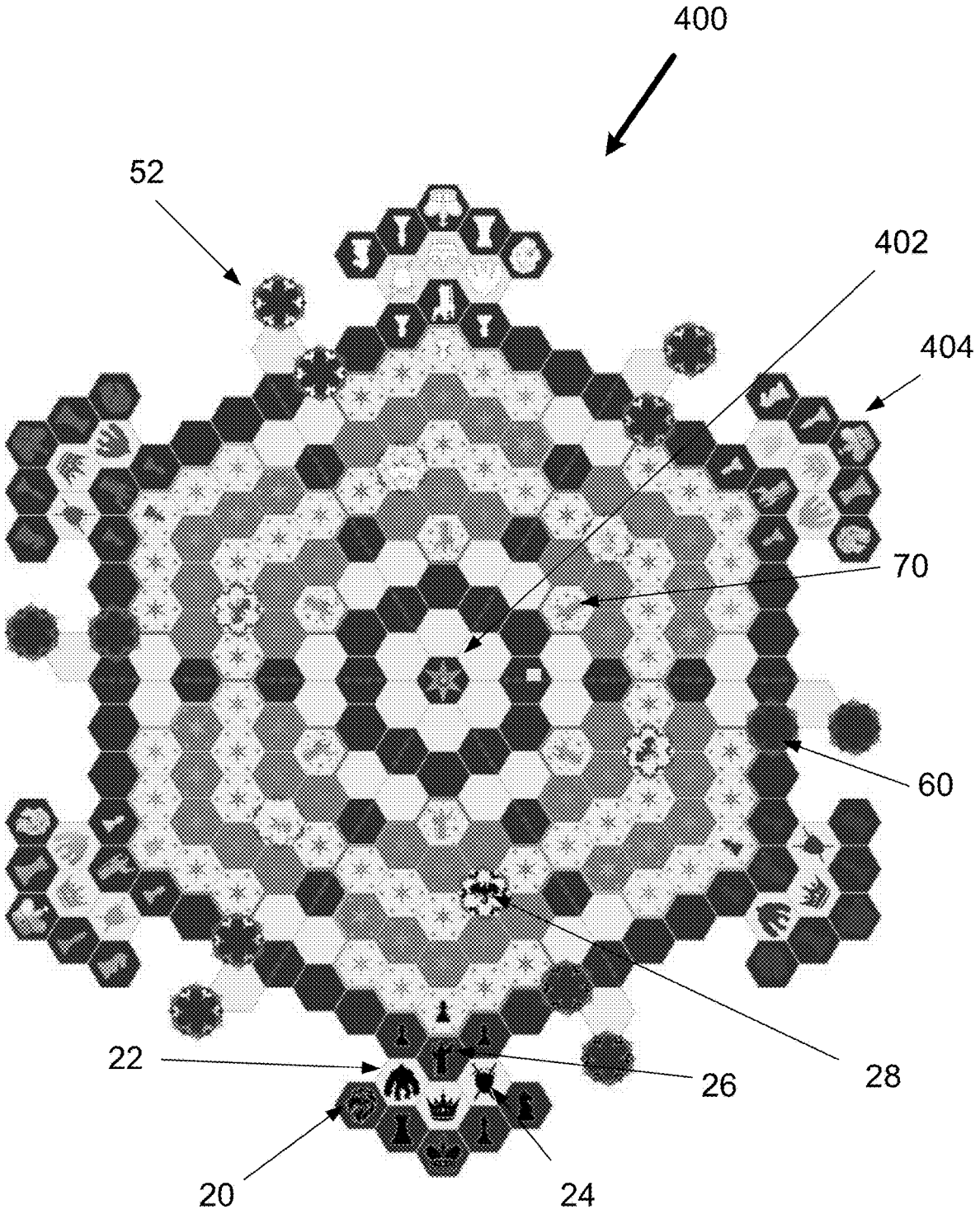
FIG. 4 shows a six-person playing board with pieces in starting positions.
Figure 5:
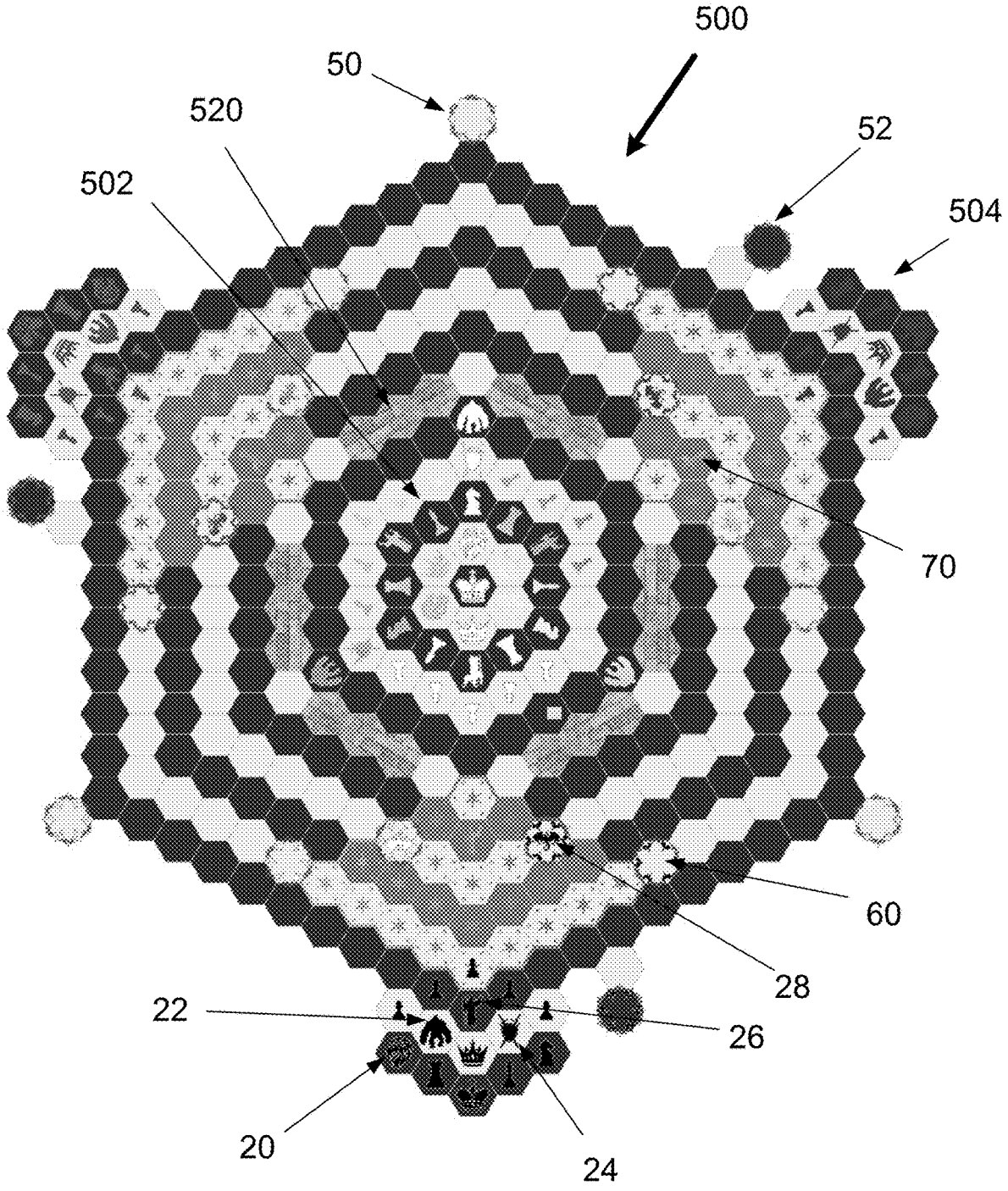
FIG. 5 shows a siege playing board with pieces in starting positions.

In various exemplary embodiments, the present invention comprises a game which is a fantasy-based variant of chess. It can be played by two to six players on one of several distinct game boards (see FIGS. 1 through 5). Game boards are two-dimensional, and comprise a plurality of square or hexagonal play spaces arranged into a variety of polygonal shapes. Square play spaces alternate in color (e.g., light, dark), while hexagonal play spaces may be arranged in concentric rings or "circuits" of alternating color (e.g., light, dark). As described below, each board is referred to as a "realm."

In a two-player embodiment (the "Wizard Realm", FIG. 1), the board 100 comprises an 8×14 center section 102, with two 2×10 player home areas or rows 104 extending from the center of opposing sides of the center section, all with square play spaces. Four single special play spaces 50 extend from each corner of the center section. Each of the two players starts with 21 matching pieces: the set of standard 16 chess pieces, plus five additional pieces 20, 22, 24, 26, 28. Certain areas of the board are specially marked 60, 70, as described below.

In a four-player embodiment (the "Dragon Realm", FIG. 2), the board 200 comprises an 14×14 center section 202, with four 2×10 player home rows 204 extending from the center of each side, all with square play spaces. Four single special play spaces 50 extend each from each corner of the center section. Each of the four players starts with 21 matching pieces: the set of standard 16 chess pieces, plus five additional pieces 20, 22, 24, 26, 28. Certain areas of the board are specially marked 60, 70, as described below.

In a three-player embodiment (the "Bishop Realm"), the board 300 comprises a center section 302 with a plurality of hexagonal play spaces forming a hexagon with 7 hexagonal play spaces along each edge. Three single special hexagonal play spaces 50 extend each from every other vertex of the center section, while clusters of 23 hexagonal spaces form a player home area 304 centered on the other vertices. Each of the three players starts with 21 matching pieces: the set of standard 16 chess pieces, plus five additional pieces 20, 22, 24, 26, 28. Certain areas of the board are specially marked 60, 70, as described below.

In a six-player embodiment (the "Melee Realm"), the board 400 comprises a center section 402 with a plurality of hexagonal play spaces forming a hexagon with 9 hexagonal play spaces along each edge. Six pairs of hexagonal play spaces (one marked as special) 52 extend from near the center of each edge of the hexagonal center section, while a cluster of 8 hexagonal spaces centered on each vertex form a player home area (including the vertex) 404. Each of the players starts with 13 matching pieces, including one each of the five additional pieces 20, 22, 24, 26, 28. Certain areas of the board are specially marked 60, 70, as described below.

In a five-player embodiment (the "Siege Realm"), the board 500 comprises a center section 502 with a plurality of hexagonal play spaces forming a hexagon with 11 hexagonal play spaces along each edge. Three single special hexagonal play spaces 50 extend each from every other vertex of the center section, while three pairs of hexagonal play spaces (one marked as special) 52 extend from near the center of three alternating edges of the hexagonal center section. Clusters cluster of 10 hexagonal spaces each centered on three alternating vertices (i.e., the vertices without special hexagonal play spaces 50) form a player home area (including the vertex) 504. Certain spaces 520 around the center are designated as impassible (e.g., castle walls). Pieces cannot move onto, through or jump over castle walls. Players are designated as attacking or defending. Each of the attacking players starts with 15 matching pieces, including one each of the 5 additional pieces 20, 22, 24, 26, 28. The defending players start with a total of 43 pieces, including three each of the five additional pieces 20, 22, 24, 26, 28. Only one defending king is used. Certain areas of the board are specially marked 60, 70, as described below.

Each of the above boards shares the following specially-marked spaces:

1. Dragon Squares or Spaces 60—marked by red flame; allows Dragon pieces to fly across the board. Isolated Dragon Squares or Spaces 50 that extend from the corners or vertices of a board may be referred to as "Dragon Lairs."

2. Wizard Squares or Spaces 70—marked by silhouette of a wizard with stars; controls a "Wizard Zone" comprising a zone of contiguous spaces marked with a star.

While the figures show embodiments with certain locations for special spaces, in alternative embodiments, these special spaces can be placed in alternative locations on the board. Similarly, the starting configurations for the pieces can vary from the configurations shown in the exemplary figures.

For the two, three and four player games, each player controls the 16 pieces of standard chess (King, Queen, Rook, Bishop, Knight, Pawn), plus five additional pieces. Unless otherwise noted herein, the movement of the standard chess pieces is according to the standard or orthodox rules of chess (such as the F.I.D.E. Laws of Chess). For the five and six player games, each player controls a subset of those pieces. Starting positions are as shown in FIGS. 1-5, although different starting configurations may be used for alternative embodiments of each game. In the two and three player games, each player plays individually, while the other games allow for individual or team play. The five player game is particularly designed for team play.

In addition to the standard chess pieces (King, Queen, Rook, Bishop, Knight, Pawn), the new pieces are the Beast 20, the Giant 22, the Mercenary 24, the Wizard 26, and the Dragon 28. The starting positions, movement rules, and capture rules for the pieces can vary depending on the board used, and are set forth more fully in the attached appendix to the specification, which is incorporated herein by specific reference. The goal of each game is to checkmate the opponent's (or opponents') kings. As with orthodox chess, players may resign, and games can end in a draw.

The game proceeds by each player choosing their color, either by agreement, by taking turns, by random selection, or other means known in the art. The first player can be determined in a similar manner, or one color can be established as the default starting color (e.g., black may be the first to move). Players then alternative turns, making one move at a time. For three or more players, turns may be taken in a clockwise or counterclockwise direction.

Starting positions generally are in player home areas, which in most cases are offset from the main board, typically between two Dragon lairs (the Siege board is an exception).

A player's Dragon piece generally begins on the Dragon square positioned in front of the corresponding player home area.

If a player makes a legal move with a piece to a space occupied by a piece of an opposing player, the opposing player's piece is captured (removed from the board). Certain pieces, such as Giants and Dragons, may capture additional opposing pieces located on spaces bordering the space to which they move (thereby allowing multiple pieces being captured in a single move).

As with orthodox chess, most pieces cannot move through or "jump" other pieces. Only the Knight, Bishop (on hexagonal-based boards), Beast, Dragon, and Wizard can "jump" other pieces. The Beast jumps like the Knight, the Dragon jumps only when flying to an unoccupied Dragon space, the Wizard jumps only when moving from one Wizard space to an unoccupied Wizard space, and the Bishop can jump on hexagonal-based boards from one concentric circuit to another of the same color. Specific details on movement of these pieces is described below.

Diagonal movement on the rectilinear boards with square spaces is as in orthodox chess. For hexagonal-based boards, movement along the circuits (the row or ring of same-colored hexagonal spaces that circles the board to reconnect to itself) is analogous to diagonal movement. For example, a Queen that starts on a circuit may travel that entire circuit if unimpeded, but must end somewhere on that circuit other than the originating space (returning back to the originating space along an unimpeded circuit does not constitute a move).

The Dragon moves like a King: one space at a time, in any direction, including diagonally. Dragons also can fly to an unoccupied Dragon square for that player (i.e., marked with that player's color), and may do from anywhere on the board. If a Dragon square is occupied, the Dragon may not move to that space (i.e., the Dragon cannot capture the piece occupying that space by flying to the space). If an opposing Dragon has been slain, then the Dragon squares for that opponent become available for any other Dragon to fly to. Any piece, friendly or not (including pieces from its own army), that is in a space adjacent to a Dragon at any time is incinerated (i.e., captured) and removed from the board. Any piece that moves to a space adjacent to a Dragon is incinerated and immediately removed. A Dragon may be captured by an enemy piece able to capture at least two spaces beyond their own starting position. When a Dragon is moved adjacent to another Dragon, both Dragons are removed from the board. When a Giant is moved adjacent to a Dragon, and the Dragon is in one of the three capture spaces controlled by the Giant, both the Dragon and Giant are removed from the board. When a Dragon is moved adjacent to an enemy King, the King is immediately removed from the board (this is a form of checkmate called "Deathmate", and ends the game if only two players remain active).

Giants generally may only move forward, and thus facing is important for this piece. Giants start out facing the side of their space relative to their initial starting position. Giants may move forward one or two spaces, or more diagonally left or right one space, maintaining that facing. Giants capture any enemy pieces in the three squares immediately before them (i.e., the space they are facing, and the immediately adjacent spaces to the right and left), and thus do not directly capture a piece in the orthodox sense. If an enemy piece is in the space two spaces in front, the Giant cannot move to that space, but only moves one square forward (or diagonally), and captures that piece. As noted above, if a Giant moves into a space adjacent to a Dragon, and the Dragon is in the Giant's capture zone, both pieces are removed. However, a Dragon can safely capture a Giant from the side or behind the Giant.

One a Giant has moved as far as possible in the forward direction (i.e., reached a back rank), the Giant may either reverse direction or clear the back rank. To reverse direction, the Giant changes facing in the direction in which it came (i.e., 180 degrees), and proceeds as above. To clear the rank, the Giant may change its facing to the left or right to indicate the direction of travel along the rank, and move, one square at a time, along the rank in the direction indicated. The Giant may not reverse direction backwards along the rank. When the end of the rank is reached, or at any point prior to that space, the Giant may elect to "reverse direction" and turn its facing to the direction in which it originally came when reaching the back rank (as described above), and proceed back through the game battlefield.

The Beast combines the dynamic movement of the Queen and the Knight. It may move like a Queen, or like a Knight, and capture enemy pieces in the same manner.

The Wizard moves and captures diagonally one or two squares at a time on a square-based board, or one or two hexagons along a line through a face of a hexagon on a hexagon-based board. A Wizard also may jump from one Wizard space that it occupies at the start of its move to any other unoccupied Wizard space. A Wizard that reaches a Wizard space allows the Wizard to control a Wizard Zone, indicated by a grouping of starred spaces around that Wizard space. Enemy pieces within the zone are prevented from moving until the Wizard moves from the Wizard space or is captured. Some boards, such as the Melee board, have a unique master Wizard space on the board (i.e., in the center), that controls all Wizard spaces and associated zones simultaneously. A Wizard in the master Wizard space supersedes the effect of a Wizard in any of the other Wizard spaces, allowing movement by that player's pieces in all zones, and prevents enemy Wizards from moving as well. Enemy pieces can move into or across the zone, and can thereby even capture pieces within the zone, as long as the enemy attack or movement originates outside the zone. If the enemy piece moves within the zone to capture, then the enemy piece cannot move thereafter, however.

The Queen can move forward, backward, sideways, or diagonally in any direction along a straight line (or along a circuit, on a hexagonal-based board). She may move any number of spaces, provided there in no obstructing piece in her path. She captures in the same way as in orthodox chess.

The Mercenary moves and captures in the same way as the Queen. However, after the Mercenary makes its first capture, it leaves the board.

The King, as in orthodox chess, is the most important piece, although not the most powerful. It moves and captures one space at a time. It cannot move into "check" or where it would be destroyed (e.g., adjacent to a Dragon). It also cannot move into a Wizard zone controlled by an enemy wizard. While a King may be subject to checkmate as in orthodox chess, in the present game it can also be dynamically captured (e.g., incinerated by a Dragon, crushed by a Giant, captured by a Wizard controlling a zone). This is referred to as "Deathmate."

The Bishop moves and captures in a similar manner to orthodox chess, particularly on a square-based board (i.e., diagonally, any number of spaces as long as unimpeded). On a hexagonal-based board, the Bishop travels along its circuit of hexagons (of a particular color) any number of spaces as long as unimpeded. The Bishop also may jump to the next circuit of the same color in either direction, with the jump being a move of two hexagons in a straight line (any piece on the hexagon between the circuits does not impeded movement). Generally speaking, a Bishop remains on spaces of the same color as its starting space. However, in games where a single Bishop per player is used, the Bishop is allowed to jump to immediately adjacent circuits of different color, as well as jump two spaces to alternating circuits of the same color. Each change of circuits constitutes a move.

The Knight on a square-based board moves and captures as in orthodox chess. On a hexagonal-based board, the Knight also moves and captures in a modified "L" shape: forward two hexagonal spaces in a straight line, then one space to the right or left away from the point of origin. The Knight can jump over other pieces, and captures pieces, as in orthodox chess.

The Rooks moves perpendicularly across the sides of the space it is on in any direction for any number of spaces, as long as unimpeded. On a hexagonal-based board, the Rook can move in a straight line through any of the six faces, and does not move based on circuits. It captures the same way as in orthodox chess, and can be used to castle with the King, as in orthodox chess.

Pawns generally move and capture as in orthodox chess, except that pawns can move one or two spaces forward throughout the game if unobstructed (not just their first move). In addition, Pawns can move forward diagonally one space, even when not capturing an enemy piece. Pawns may be promoted to any piece per orthodox chess rules, with the following changes:

Wizard realm: pawns promote when they reach a space from which no further forward movement is possible (thus, the Dragon Lair spaces on the corners are considered promotion squares).

Dragon realm: pawns promote when reaching any space in the "back rank" in any player's home area (the outside squares along the right and left sides as well as the opposing side), or when reaching a space from which no further forward movement is possible (e.g., Dragon Lair spaces)

Bishop realm: pawns promote when reaching any space in the "back rank" in any player's home area, or Dragon Lair space, that is beyond the midway point on the board from that player's starting perspective.

Melee realm: pawns promote when reaching any space in the "back rank" in any enemy player's home area, or Dragon Lair space, that is beyond the midway point on the board from that player's starting perspective.

Siege realm: no promotion permitted.

Castling rules are similar to those for orthodox chess. Castling is not permitted on the 5 or 6 player boards.

Checkmating rules are similar to those for orthodox chess. A King place in check must move out of check, capture all pieces placing the King in check, interpose a piece between the King and the attacking pieces to block the attack (if the attacking piece is not one that can jump over the interposed piece), or move a Wizard to control the attacking pieces (i.e., prevent them from moving). Check may not originate from within a controlled Wizard zone, although removing the Wizard's control can permit check. If an enemy's Wizard moves to a Wizard zone and thereby place the King within its control zone, the King is considered to be in check (and movement of the King will not alleviate the check). If the check condition is not removed or blocked, the King is checkmated, and the checkmated army is removed from the field if more than two players remain active on the board. If there are only two players, the game is over.

As described above, Giants and Dragons can eliminate an King through Deathmate. Elimination of the King is treated like checkmate, depending on the number of players remaining active. A Dragon can Deathmate its own King, thereby causing loss of the game or removal of all of that player's pieces (including the Dragon). As in orthodox chess, a player can resign on their turn, prior to making any move. Resignation is treated like checkmate, depending on the number of players remaining active.

Games can result in a draw in a similar manner to orthodox chess: i.e., if there is no possibility of checkmate for either side, if the parties repeat a position three or more times in a row, or if the parties agree to a draw. If a player is not in check, but has no legal move, the game results in a stalemate. The game also may be a draw if there has been no pawn advancement or pieces captured by either player in the last 50 moves.

The Siege board, being designed for team play, has some further modifications to the above rules. On the Siege board, three players surround a castle under siege, and cooperate as the attacking team. The remaining player cooperate as the defending team, defending a castle in the center. If there are five players, there are two defenders, each handling their own army, and taking turns moving the White pieces. The defending team wins when the Black King is checkmated or eliminated (regardless of the status of the other two armies). Likewise, the attacking team wins when the White King is defeated. In one embodiment, play begins with Black, followed by White, and alternating between the attacking team and defending teams thereafter, each player having a turn in order. Players on a team are expected to work cooperatively, form battle plans, and the like.

The castle wall spaces on the Siege board are impassible (players cannot land on them, or pass through them, even for pieces that can "jump"). The spaces between the castle walls are considered gates, and Pawns and Giants orient themselves by whichever gate they emerge from. There are two circuits around the castle walls: an inner circuit, and an outer circuit. Giants and Pawns within the castle may move (one or two spaces in either direction) around the inner circuit that borders the castle walls until they enter and emerge from a gate, which sets the piece's orientation as it moves towards the periphery of the board. The circuit that border the outside of the castle walls similarly is available to attacking Giants and Pawns, which may move around the circuit until committing to an attack at any of the castle gates. Pawns and Giants defending the castle only use the inner castle circuit as a special circuit, while Pawns and Giants attacking the castle only use the outer castle circuit as a special circuit. Once on a circuit, Giants and Pawns may go in either direction along the circuit and must stay on the circuit until entering a castle gate. All movement by Giants and Pawns along their special circuits is one or two spaces at a time (these circuits function as normal circuits for all other pieces).

Once a Giant or Pawn enters a gate, it cannot retreat. The forward orientation is based relative to the center space of the board. Defending Giants and Pawns orient themselves to face directly away from the center space, while attacking Giants and Pawns orient themselves to face directly towards the center space.

The attacking or "kill" zone for Giants thus will change as the piece moves around its respective circuit (facing forward along the circuit in the direction of movement). For example, an attacking Giant's kill zone will vary from two to three to four spaces, while a defending Giant's kill zone may two to three to five spaces. Pawns moving on the circuit move the same as Giants, but they do not have "kill" zones, and cannot capture pieces on a space directly before them.

Pawns may capture when moving off the circuit into a gate, unless the capture is considered forward for the gate chosen.

Pawns and Giants that progress as far as possible to a back rank or Dragon Lair may reverse direction (or clear the rank, in the case of Giants), as described above for Giants. Pawn promotion is not permitted.

Additional information on movement and capture is described in the attached appendix, which is incorporated herein by specific reference for all purposes.

The boards of the present invention may be embodied as physical boards, or as a computer-based game suitable for play on a computer, tablet, smart phone, or other computing device. In the latter form, the players can play over a private or public network (e.g., the Internet) against each other locally or remotely, without a computer playing a side. In alternative embodiments, a computer can play one or more of the sides.

In order to provide a context for the various computer-implemented aspects of the invention, the following discussion provides a brief, general description of a suitable computing environment in which the various aspects of the present invention may be implemented. A computing system environment is one example of a suitable computing environment, but is not intended to suggest any limitation as to the scope of use or functionality of the invention. A computing environment may contain any one or combination of components discussed below, and may contain additional components, or some of the illustrated components may be absent. Various embodiments of the invention are operational with numerous general purpose or special purpose computing systems, environments or configurations. Examples of computing systems, environments, or configurations that may be suitable for use with various embodiments of the invention include, but are not limited to, personal computers, laptop computers, computer servers, computer notebooks, hand-held devices, microprocessor-based systems, multiprocessor systems, TV set-top boxes and devices, programmable consumer electronics, cell phones, personal digital assistants (PDAs), tablets, smart phones, touch screen devices, smart TV, internet enabled appliances, internet enabled security systems, internet enabled gaming systems, internet enabled watches; internet enabled cars (or transportation), network PCs, minicomputers, mainframe computers, embedded systems, virtual systems, distributed computing environments, streaming environments, volatile environments, and the like.

Embodiments of the invention may be implemented in the form of computer-executable instructions, such as program code or program modules, being executed by a computer, virtual computer, or computing device. Program code or modules may include programs, objections, components, data elements and structures, routines, subroutines, functions and the like. These are used to perform or implement particular tasks or functions. Embodiments of the invention also may be implemented in distributed computing environments. In such environments, tasks are performed by remote processing devices linked via a communications network or other data transmission medium, and data and program code or modules may be located in both local and remote computer storage media including memory storage devices such as, but not limited to, hard drives, solid state drives (SSD), flash drives, USB drives, optical drives, and internet-based storage (e.g., "cloud" storage).

In one embodiment, a computer system comprises multiple client devices in communication with one or more server devices through or over a network, although in some cases no server device is used. In various embodiments, the network may comprise the Internet, an intranet, Wide Area Network (WAN), or Local Area Network (LAN). It should be noted that many of the methods of the present invention are operable within a single computing device.

A client device may be any type of processor-based platform that is connected to a network and that interacts with one or more application programs. The client devices each comprise a computer-readable medium in the form of volatile and/or nonvolatile memory such as read only memory (ROM) and random access memory (RAM) in communication with a processor. The processor executes computer-executable program instructions stored in memory. Examples of such processors include, but are not limited to, microprocessors, ASICs, and the like.

Client devices may further comprise computer-readable media in communication with the processor, said media storing program code, modules and instructions that, when executed by the processor, cause the processor to execute the program and perform the steps described herein. Computer readable media can be any available media that can be accessed by computer or computing device and includes both volatile and nonvolatile media, and removable and non-removable media. Computer-readable media may further comprise computer storage media and communication media. Computer storage media comprises media for storage of information, such as computer readable instructions, data, data structures, or program code or modules. Examples of computer-readable media include, but are not limited to, any electronic, optical, magnetic, or other storage or transmission device, a floppy disk, hard disk drive, CD-ROM, DVD, magnetic disk, memory chip, ROM, RAM, EEPROM, flash memory or other memory technology, an ASIC, a configured processor, CDROM, DVD or other optical disk storage, magnetic cassettes, magnetic tape, magnetic disk storage or other magnetic storage devices, or any other medium from which a computer processor can read instructions or that can store desired information. Communication media comprises media that may transmit or carry instructions to a computer, including, but not limited to, a router, private or public network, wired network, direct wired connection, wireless network, other wireless media (such as acoustic, RF, infrared, or the like) or other transmission device or channel. This may include computer readable instructions, data structures, program modules or other data in a modulated data signal such as a carrier wave or other transport mechanism. Said transmission may be wired, wireless, or both. Combinations of any of the above should also be included within the scope of computer readable media. The instructions may comprise code from any computer-programming language, including, for example, C, C++, C#, Visual Basic, Java, and the like.

Components of a general purpose client or computing device may further include a system bus that connects various system components, including the memory and processor. A system bus may be any of several types of bus structures, including, but not limited to, a memory bus or memory controller, a peripheral bus, and a local bus using any of a variety of bus architectures. Such architectures include, but are not limited to, Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computing and client devices also may include a basic input/output system (BIOS), which contains the basic routines that help to transfer information between elements within a computer, such as during start-up. BIOS typically is stored in ROM. In contrast, RAM typically contains data or program code or modules that are accessible to or presently being operated on by processor, such as, but not limited to, the operating system, application program, and data.

Client devices also may comprise a variety of other internal or external components, such as a monitor or display, a keyboard, a mouse, a trackball, a pointing device, touch pad, microphone, joystick, satellite dish, scanner, a disk drive, a CD-ROM or DVD drive, or other input or output devices. These and other devices are typically connected to the processor through a user input interface coupled to the system bus, but may be connected by other interface and bus structures, such as a parallel port, serial port, game port or a universal serial bus (USB). A monitor or other type of display device is typically connected to the system bus via a video interface. In addition to the monitor, client devices may also include other peripheral output devices such as speakers and printer, which may be connected through an output peripheral interface.

Client devices may operate on any operating system capable of supporting an application of the type disclosed herein. Client devices also may support a browser or browser-enabled application. Examples of client devices include, but are not limited to, personal computers, laptop computers, personal digital assistants, computer notebooks, hand-held devices, cellular phones, mobile phones, smart phones, pagers, digital tablets, Internet appliances, and other processor-based devices. Users may communicate with each other, and with other systems, networks, and devices, over the network through the respective client devices.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A method of playing a modified chess game, comprising:

(A) providing a modified chess board having at least 90 hexagonal play spaces, forming a central hexagon with five or more concentric rings around a single central playing space, said central hexagon with six sides and six vertices, with each concentric ring differing from each adjacent concentric ring by color, with three symmetric clusters of hexagonal play spaces centered on and extending from at least three vertices of the central hexagon, and with three or more specially marked circumferential hexagonal playing spaces outside of and extending from the central hexagon and distinct from the central hexagon and the three symmetric clusters, said circumferential hexagonal playing spaces isolated and connected to no more than one other adjacent space through a mutual side further wherein at least three of said concentric rings are the same color, and each hexagonal play space in said at least three concentric rings is adjacent to at least two other hexagonal play spaces of the same color;

(B) providing at least three sets of game pieces, the sets differing from each other by color, each set comprising a subset of standard chess pieces and a subset of additional game pieces, each subset of standard chess pieces comprising a king, a queen, a rook, a bishop, a knight, at least three pawns, and each subset of additional game pieces comprising four additional game pieces, namely, a first additional game piece, a second additional game piece, a third additional game piece, and a fourth additional game piece;

(C) initially arranging each set of game pieces in a corresponding initial setting on said playing board, with said second, third and fourth additional game pieces intermingled with said standard chess pieces, the initial setting for each set of game pieces including at least a portion of a respective symmetric cluster of hexagonal play spaces extending from a vertex of the central hexagon; and (D) playing an altered game of chess by alternating moves sequentially among the at least three sets of game pieces, wherein (i) all pieces capable of moving two or more spaces are assigned a first property that any movement permissible along a straight line also includes circumferential movement along one of said concentric rings in the central hexagon;

(ii) the first additional game piece is movable one space at a time in any direction to land on an adjoining space;

(iii) the first additional game piece can capture any piece of a different set that occupies any space adjacent to a space occupied by that dragon first additional game piece without said first additional game piece moving into the space of the captured piece;

(iv) the third additional game piece is movable one or two spaces in a straight line at a time in any direction to land on a space;

(v) the second additional game piece is movable any number of spaces in a straight line, or alternatively, two spaces in a straight line and then one space right or left, to land on a space;

(vi) the fourth additional game piece is movable one or two spaces forward in a straight line, or one space to the right or left of the space immediately forward, to land on a space; and (vii) the fourth additional game piece can capture any piece of a different set that occupies any of the three spaces immediately forward of and adjacent to a space occupied by that giant piece.

2. The game of claim 1, wherein:

each subset of standard chess pieces consists of one king piece, one queen piece, seven pawn pieces, two bishop pieces, two knight pieces, and two rook pieces.

3. A method of playing a modified chess game, comprising:

(A) providing a modified chess board having exactly 277 hexagonal play spaces, forming a central hexagon of 217 hexagonal play spaces with eight concentric rings around a single central playing space, said central hexagon with six sides and six vertices, with each concentric ring differing from each adjacent concentric ring by color, with six symmetric clusters each with 8 hexagonal play spaces outside of the central hexagon and centered on and extending from the vertices of the central hexagon, and with twelve circumferential hexagonal playing spaces outside of and extending from the central hexagon and distinct from the central hexagon and the six symmetric clusters, with six of said circumferential hexagonal playing spaces isolated and connected to no more than one other adjacent space through a mutual side;

(B) providing six sets of game pieces, the sets differing from each other by color, each set comprising a subset of standard chess pieces and a subset of additional game pieces, each subset of standard chess pieces comprising a king, a queen, a rook, a bishop, a knight, at least three pawns, and each subset of additional game pieces comprising four additional game pieces, namely, a first additional game piece, a second additional game piece, a third additional game piece, and a fourth additional game piece;

(C) initially arranging each set of game pieces in a corresponding initial setting on said playing board, with said second, third and fourth additional game pieces intermingled with said standard chess pieces, the initial setting for each set of game pieces including at least a portion of a respective symmetric cluster of hexagonal play spaces extending from a vertex of the central hexagon; and (D) playing an altered game of chess by alternating moves sequentially among the six sets of game pieces, wherein (i) all pieces capable of moving two or more spaces are assigned a first property that any movement permissible along a straight line also includes circumferential movement along one of said concentric rings in the central hexagon;

(ii) the first additional game piece is movable one space at a time in any direction to land on an adjoining space;

(iii) the first additional game piece can capture any piece of a different set that occupies any space adjacent to a space occupied by that first additional game piece without said first additional game piece moving into the space of the captured piece;

(iv) the third additional game piece is movable one or two spaces in a straight line at a time in any direction to land on a space;

(v) the second additional game piece is movable any number of spaces in a straight line, or alternatively, two spaces in a straight line and then one space right or left, to land on a space;

(vi) the fourth additional game piece is movable one or two spaces forward in a straight line, or one space to the right or left of the space immediately forward, to land on a space; and (vii) the fourth additional game piece can capture any piece of a different set that occupies any of the three spaces immediately forward of and adjacent to a space occupied by that giant piece;

wherein each subset of standard chess pieces consists of one king piece, one queen piece, three pawn pieces, one bishop piece, one knight piece, and one rook piece.

4. A method of playing a modified chess game, comprising:

(A) providing a modified chess board having exactly 370 hexagonal play spaces, forming a central hexagon of 331 hexagonal play spaces with ten concentric rings around a single central playing space, said central hexagon with six sides and six vertices, with each concentric ring differing from each adjacent concentric ring by color, with three symmetric clusters each with 10 hexagonal play spaces outside of the central hexagon and centered on and extending from three alternating vertices of the central hexagon, and with six circumferential hexagonal playing spaces outside of and extending from the central hexagon and distinct from the central hexagon and the six symmetric clusters, with three of said circumferential hexagonal playing spaces isolated and connected to no more than one other adjacent space through a mutual side;

(B) providing six sets of game pieces, the sets differing from each other by color, each set comprising a subset of standard chess pieces and a subset of additional game pieces, each subset of standard chess pieces comprising a king, a queen, a rook, a bishop, a knight, at least three pawns, and each subset of additional game pieces comprising four additional game pieces, namely, a first additional game piece, a second additional game piece, a third additional game piece, and a fourth additional game piece;

(C) initially arranging each set of game pieces in a corresponding initial setting on said playing board, with said second, third and fourth additional game pieces intermingled with said standard chess pieces, the initial setting for each set of game pieces including at least a portion of a respective symmetric cluster of hexagonal play spaces extending from a vertex of the central hexagon; and (D) playing an altered game of chess by alternating moves sequentially among the six sets of game pieces, wherein (i) all pieces capable of moving two or more spaces are assigned a first property that any movement permissible along a straight line also includes circumferential movement along one of said concentric rings in the central hexagon;

(ii) the first additional game piece is movable one space at a time in any direction to land on an adjoining space;

(iii) the first additional game piece can capture any piece of a different set that occupies any space adjacent to a space occupied by that first additional game piece without said first additional game piece moving into the space of the captured piece;

(iv) the third additional game is movable one or two spaces in a straight line at a time in any direction to land on a space;

(v) the second additional game piece is movable any number of spaces in a straight line, or alternatively, two spaces in a straight line and then one space right or left, to land on a space;

(vi) the fourth additional game piece is movable one or two spaces forward in a straight line, or one space to the right or left of the space immediately forward, to land on a space; and (vii) the fourth additional game piece can capture any piece of a different set that occupies any of the three spaces immediately forward of and adjacent to a space occupied by that giant piece;

wherein each subset of standard chess pieces consists of one king piece, one queen piece, five pawn pieces, one bishop piece, one knight piece, and one rook piece.

* * * * *